US006419762B2

(12) United States Patent
Prskawetz et al.

(10) Patent No.: US 6,419,762 B2
(45) Date of Patent: Jul. 16, 2002

(54) HEAT-TREATED PROFILED ROLLING STOCK

(75) Inventors: Georg Prskawetz; Peter Pointner; Alfred Moser, all of Leoben (AT)

(73) Assignee: Voest-Alpine Schienen GmbH, Donawitz (AT)

( * ) Notice: Subject to any disclaimer, the term of this patent is extended or adjusted under 35 U.S.C. 154(b) by 0 days.

(21) Appl. No.: 09/814,710

(22) Filed: Mar. 23, 2001

Related U.S. Application Data

(63) Continuation of application No. 09/570,455, filed on May 12, 2000, now Pat. No. 6,224,694, which is a continuation of application No. 08/320,408, filed on Oct. 3, 1994, now abandoned.

(30) Foreign Application Priority Data

Jul. 19, 1994 (AT) ..... 1431/94

(51) Int. Cl.[7] ..... C22C 38/58
(52) U.S. Cl. ..... 148/333; 148/581
(58) Field of Search ..... 148/581, 320, 148/333

(56) References Cited

U.S. PATENT DOCUMENTS

| | | | |
|---|---|---|---|
| 2,087,346 A | | 7/1937 | Johnston |
| 4,082,577 A | | 4/1978 | Heller |
| 4,375,995 A | * | 3/1983 | Sugino et al. |
| 4,486,243 A | | 12/1984 | Lambert et al. |
| 4,714,500 A | * | 12/1987 | Heller et al. |
| 4,913,747 A | * | 4/1990 | Fukuda et al. |

FOREIGN PATENT DOCUMENTS

| | | |
|---|---|---|
| AT | 323224 | 6/1975 |
| DE | 2820784 | 11/1978 |
| DE | 3006695 | 8/1981 |
| DE | 3446794 | 1/1986 |
| DE | 4003363 | 3/1991 |
| DE | 4237991 | 5/1994 |
| EP | 0186373 | 7/1986 |
| EP | 0187904 | 7/1986 |
| EP | 0293002 | 11/1988 |
| WO | 94/02652 | 2/1994 |

* cited by examiner

*Primary Examiner*—Sikyin Ip
(74) *Attorney, Agent, or Firm*—Greenblum & Bernstein, P.L.C.

(57) ABSTRACT

A railroad rail of a steel alloy having a pearlitic microstructure, which rail has a good long-term serviceability, high ductility and high abrasion resistance of the working surface at the rail head, the rail being formed of a steel alloy having a chemical composition in weight % of 0.4 to 1.0 carbon, 0.1 to 1.2 silicon, 0.5 to 3.5 manganese, up to 1.5 chromium, optionally other alloy elements below 1 weight %, the rest being iron and impurities, and at least the rail head having a portion of fine pearlitic microstructure and a hardness between 340 HB and 425 HB down to a sufficient depth from the top surface, the arrangement and the extension of the portion of fine pearlitic microstructure in the rail cross section being even along the entire length of the rail.

3 Claims, 2 Drawing Sheets

HEAT-TREATED PROFILED ROLLING STOCK

CROSS-REFERENCE TO RELATED APPLICATIONS

The present application is a continuation of U.S. patent application Ser. No. 09/570,455 filed May 12, 2000, now U.S. Pat. 6,224,694, which is a continuation of U.S. patent application Ser. No. 08/320,408 filed Oct. 3, 1994, now abandoned, which claims priority under 35 U.S.C. § 119 of Austrian Patent Application No. A 1431/94 filed Jul. 19, 1994, the disclosures of all three documents are expressly incorporated by reference herein in their entireties.

BACKGROUND OF THE INVENTION

1. Field of the Invention

The invention relates to a method for heat-treating profiled rolling stock, in particular track or railroad rails, with an increased heat removal from portions of the profile surface during cooling in the gamma range of the basic iron material, wherein a conversion into a fine pearlitic grain of increased strength, in particular increased wear resistance and increased hardness takes place in the desired cross-sectional area(s), particularly in the head area of rails, and, if required, a deformation or bending by a thermally caused warping of the rolling stock, in particular the rail, perpendicularly to the longitudinal axis is decreased, preferably essentially prevented, during cooling to room temperature, particularly following a structural conversion in the more heavily cooled cross-sectional area(s), and an increased rigidity and fatigue strength under reversed bending stresses is achieved.

The invention further relates to a device for the heat treatment of profiled rolling stock, in particular track or railroad rails, essentially including at least one stand-by area for the rolling stock at the roller table, with a rolling stock positioning device, a cooling treatment area, with devices for partial high intensity heat removal from the surface of the rolling stock and a final cooling area for cooling the rolling stock to room temperature, as well as depositing, transverse transporting, stopping and manipulating device.

Finally, the invention relates to profiled rolling stock, in particular to a track or railroad rail, including of a rail head of an at least partial pearlitic grain structure, a rail base and a web between the rail head and the rail base.

2. Discussion of Background Information

Profiled rolling stock, in particular track or railroad rails, is mainly produced from basic iron alloys with weight-% contents between 0.4 and 1.0 C, 0.1 and 1.2 Si, 0.5 and 3.5 Mn, if required up to 1.5 Cr, as well as other alloy elements at concentrations below 1%, the rest being iron and impurities occurring in the manufacturing process. Based on the usual dimensions, for example a weight between 30 to 100 kg/m, and the ratio of cross section to circumference of rails resulting therefrom, during cooling of the rolling stock from the conversion heat in still air, for example on cooling beds and the like, a conversion of the grain from an austenitic into a rough pearlitic structure, possibly having portions of ferrite, because of slow cooling, takes place. The previously mentioned materials having the above structure have a hardness in the range between 250 HB to 350 HB.

An increase in traffic and larger axial loads, as well as the desire to improve the durability of rails in practical use has resulted in a multitude of suggestions for increasing the strength and wear resistance of the material. In the course of this it is possible to achieve more advantageous or improved material properties with a hardness of 400 HB and above by measures in respect to heat treatment and/or alloy techniques.

However, rails should be easy to weld in the field for reasons, among others, of forming shock-free sections or multiple lengths, so that measures in respect to alloy techniques for increasing the hardness or strength and durability of the material can mostly be applied on a small scale only due to the welding problems and are aimed to a heat treatment matched to the composition of the steel (German Patent Publication DE-C 34 46 794, European Patent Publications EP-B-0 187 904, EP-B-0 186 373). For economic reasons, such methods have also not proven themselves on a large scale.

To increase the useful properties of rails and switch parts made from the above mentioned materials it is possible and known to one skilled in the art to provide a fine pearlitic material structure by a thermal tempering treatment. In the process it is important to set appropriate cooling conditions or cooling rates for the cool-down from the austenitizing temperature. For example, European Patent Publication EP-B-0 293 002 suggests for this purpose to perform, after an initially high cooling intensity, a practically isothermic structural conversion at approximately 530° C. It is furthermore known from German Published, Non-Examined Patent Application DE-OS 28 20 784 to perform hardening of rails of a defined composition in boiling water and to achieve a desired cooling intensity for setting a fine pearlitic structural state by additives and movement steps.

In accordance with Austrian Patent AT-PS-323 224 it had also been suggested to produce rails with a homogeneous fine pearlitic structure from a selected alloy by the application of defined cooling parameters, for example a cooling speed between 10 and 20° C./s down to a temperature of no more than 550° C. However, the above steps have the common disadvantage that, depending on the mass concentration of the rolling stock profile, an even cooling intensity of the surface can cause different cooling speeds and structural forms in the zones close to the surface, and that it is often necessary to take elaborate precautions to prevent undesired local structural form or material properties, in particular excessive hardness and brittleness, in parts of the rail which are primarily stressed by bending.

In many cases it was also proposed to provide in a directed manner a heterogeneous microstructure in the cross section of a rail in accordance with the respective stresses. For example, a method is known from German Patent Publication DE-C-30 06 695, in accordance with which a conversion over the entire cross section is caused from the rolling heat by cooling the rail, after which the head of the rail is re-austenitized by inductive heating and subsequently hardened. In accordance with WO94/02652 it was further proposed to cool the rail head to a surface temperature between 450 and 550° C. in a cooling medium of a specially set cooling intensity and in this way to create a fine pearlitic grain therein. A device for the suspended hardening of rails in accordance with German Patent Publication DE-C-40 03 363 is suitable for such treatment.

However, the inhomogeneous cooling over the cross section of profiled rolling stock can lead to curvatures or deviations from the straightness at room temperature. To avoid this disadvantage it has been proposed (German Patent Publication DE-A-42 37 991) to transport or cool rails suspended, preferably with the head down, on a cooling bed, however, a directed formation of a heterogeneous grain structure over the cross section is hardly possible here.

All of the methods and devices known up to now have the common disadvantage that although they disclose solutions in limited areas or regarding individual method steps leading to the desired goal in the manufacture of profiled rolling stock, overcoming all the problems in a satisfactory way cannot be shown in connection with an economical production of long rails of high quality and with special finishing properties.

SUMMARY OF THE INVENTION

The invention is intended to provide relief in this area and its object is, while removing the disadvantages of the known production types, to recite a novel method by which profiled rolling stock having particularly advantageous useful properties can be produced. It is a further object of the invention to make available a device especially for executing the method and to design rolling stock, in particular a rail, for highest stresses.

In a method in accordance with the species this object is attained in that the rolling stock, in particular the rail, at an average temperature of at most 1100° C., preferably at most 900° C., but at least 750° C., and aligned straight in its longitudinal direction during its plastic shaping, is in its aligned state moved into a transverse direction and held there and, in a first step of cooling the rolling stock or the rail, it is allowed to cool evenly to a temperature below 860° C., preferably approximately 820° C., in particular to 5 to 120° C. above the $Ar_3$ temperature of the alloy with the same local cooling intensity, preferably essentially by radiation in still air. In a second step of cooling, heat is removed from the rolling stock in the longitudinal direction with an intensity which locally is essentially the same, but viewed in cross section is circumferentially different, and the cooling intensity in at least one zone at the circumference of the profiled rolling stock is increased, wherein the larger cooling intensity(ies) are assigned to the area(s) with a large ratio of the cross section to the circumference or with a large portion of volume in respect to the surface or with a high mass concentration and/or those with locally high temperatures of the rolling stock, and the area(s) of a cooling speed increased in this manner is (are) brought to the conversion temperature, under which cooling condition a fine pearlitic grain structure free of martensite is formed. Then, in a subsequent step, cooling to room temperature at the same local cooling intensity, for example in still air, is performed.

It is important that a straight alignment of the rolling stock during plastic shaping takes place and this is performed within a temperature range between 750° C. and 1100° C. It has been found that lower temperatures than 750° C. can lead to partially resilient bending with deviations from the straight alignment and as a result to inhomogeneous cooling intensity in the longitudinal direction of the rail. In most cases rolling stock temperatures above 1100° C. cause a growth of the austenite bodies or the formation of rough grains, by which the material properties can be disadvantageously affected in the end. Based on straight aligned rolling stock, it has been found to be important for the formation of a fine pearlitic area of the cross section which is evenly developed in the longitudinal direction that the rolling stock is held and allowed to cool evenly in a first cooling step to a temperature below 860° C. at the same local cooling intensity. In the process it is possible, on the one hand, to compensate a local inhomogeneity of the temperature distribution in the longitudinal direction which possibly might have been caused by the partial resting on a transverse transport device, on the other hand an axially symmetrical or center-symmetrical temperature distribution is provided in the cross section of the profiled rolling stock and in this way its straightness is stabilized. It is particularly advantageous to perform this compensating cooling to a temperature of 5 to 120° C. above the $Ar_3$ temperature of the alloy in order to provide advantageous conditions for a partial conversion of the grain into a fine pearlitic structural shape in portions of the cross section. In this case the $Ar_3$ temperature is the temperature at which a conversion of the gamma grid into the alpha grid of the alloy begins at a cooling velocity of 3° C./min.

Cooling of the rolling stock at an intensity of heat removal which in the longitudinal direction is essentially the same but, viewed in cross section is different circumferentially is known per se. However, it is important to assign the areas of increased cooling intensity of the surface to correspond with the mass concentration of the rolling stock. In connection with a straight alignment, compensating cooling and setting of a symmetrical temperature distribution and an assignment of the cooling areas it is possible to maintain a cooling speed, which is different over the cross-sectional areas, but essentially the same in the longitudinal direction of the rolling stock. In this connection it is important to set the value of the cooling speed with which the selected area of the rolling stock is brought to the conversion temperature in a manner known per se. As can be seen in FIG. 3, which is a time-temperature conversion diagram of an alloy of known composition and is known to one skilled in the art, in the course of higher rates of cooling from the $Ar_3$ temperature, for example the curves c and d, martensite parts are formed in the grain, because of which the material achieves greater hardness, but loses considerably in elasticity and has increased breaking tendencies and the intended use is no longer possible. Low cooling rates, for example those of the curve h, create a rough pearlitic soft grain structure. Thus, it is important to set the local cooling rates high enough that martensite formation during conversion is prevented in every case, but that a fine pearlitic grain is created in the area of increased cooling intensity. Following the complete grain conversion, the rolling stock is brought to room temperature at the same local cooling intensity in order to reduce or to essentially prevent bending of the rolling stock.

It is particularly advantageous if the heat treatment is performed by the hot forming heat following the hot forming of the rolling stock at a deforming degree of 1.8 to 8%, preferably 2 to 5%, during the last tapping at a temperature of at least 750° C. and at most 1050° C. A final deformation with a deformation degree or a cross-sectional reduction of 1.8 to 8% causes an advantageous austenite grain refining if conversion takes place in a temperature range between 770° C. to 1050° C. It has been shown that lesser conversion degrees than 1.8 cause a particularly strong rough grain or grain growth in places, but larger conversions than 8% cause a large temperature increase in central or interior areas, apparently because of released conversion energy, because of which inhomogeneities in the grain can be caused locally and reductions in quality can occur.

In view of receiving essentially straight aligned or axially aligned rolling stock after cooling to room temperature and particularly in view of rails having increased rigidity and fatigue strength under reversed bending stresses, it is of great advantage if in the second step of cooling the cooling intensity is increased in two or more zones at the circumference of the profiled rolling stock. In this manner, it is possible to achieve increased hardness and increased strength of the material in several areas of a cross-sectional surface close to the surface because of a finer pearlitic structure of the grain. In case of bending stresses of the rolling stock, wherein the cross-sectional zones which are farthest distant from the neutral grain or zero line show the greatest stress, it is now possible to embody at least two of these peripheral zones to have increased strength. It has been found that with a rail it is also possible to increase the fracture toughness of the material the base area.

In a preferred manner, the portion of the rolling stock having the largest mass concentration, for example the head of the rail, is cooled in a dipping process or by being dipped into a cooling liquid, while simultaneously heat is removed by via lesser cooling intensity, for example compressed air or air-water spraying, from the rolling stock part(s) with a lesser mass concentration, for example the base of the rail, which are intended to be provided with increased cooling. Proceeding in this way it is possible to counteract the formation of a high interior tension state and thermal warping of the rolling stock.

In order to prevent a disadvantageous martensite formation and to achieve a fine pearlitic structure of the grains in the alloys on an iron base mentioned at the outset, it is advantageous if the degree of cooling intensity, in particular the composition of the cooling liquid for the dip cooling, is set in such a way that, in the temperature range between 800° C. to 450° C., cooling of the zone close to the surface of the dipped part in particular is achieved at 1.6 to 2.4° C./s, preferably at approximately 2.0° C./s. This cooling speed is preferred for economical reasons, because when a desired quality of the rolled product has been achieved, a short cooling time in the second step is required and in this way a large throughput is achieved.

To minimize the curvature it has been shown to be advantageous if with profiled rolling stock of T-shaped cross section such as is present, for example, at the base of a rail, the zone or surface opposite the web is cooled at higher intensity, preferably by compressed air or an air-water mixture. In the process it has been found in view of the improvement of the long term properties to be particularly advantageous if the surface zone located opposite the web of increased cooling intensity is embodied to be essentially symmetrical in respect to the web axis and is laterally limited.

Furthermore, if it is intended to prevent an increased cooling intensity of the areas of the cross section of the profiled rolling stock which are distal in respect to a mass concentration or a web juncture and/or to protect these areas from an increased heat removal or at least to heat them briefly, it is possible to provide a grain of the same or decreased material strength in the edges of the rolling stock. Surprisingly this lowers the danger of breaking, particularly in case of sharp and/or changing continuous stresses of the rolled material.

It is possible to achieve a special strength of the shape if the cooling intensity at the surface of the profiled rolling stock, in particular the rail, is set in such a way that the zones in which the conversion of the gamma grain takes place during cooling are essentially embodied to be parallel symmetrical and/or parallel to the neutral plane, preferably concentric to the line of the center of gravity or the center of gravity of the cross-sectional surface.

In order to achieve an essentially completely even local cooling intensity in the longitudinal direction and to maintain the heat transfer into the cooling medium stable, it can be provided in accordance with the invention that the rolling stock, a part of which in respect to the cross section is dipped into a cooling liquid in a dip tank, is moved in this longitudinal direction relative to the cooling liquid container or dip tank during cooling and/or that at least during the time in which a portion of the rolling stock is dipped into the cooling liquid the latter is charged with an oscillation or is made to oscillate. It has been found that these measures decisively improve the homogeneity of the achieved quality.

A device of the type mentioned at the outset for the integral solution of the problems when producing profiled rolling stock having special properties, is distinguished in accordance with the invention in that the roller bed in the stand-by area has a rolling stock positioning device, known per se, and a device for the straight or axially aligned positioning of the profiled rolling stock during its plastic shaping, has a transverse transport device for a straight or axially aligned transfer of the rolling stock essentially perpendicularly to its axis from the stand-by area into the cooling treatment area, in which area a device, known per se, for hardening rolling stock, in particular the head of rails, via cooling liquid in a dip tank with holding and manipulation devices and a controllable additional cooling device for more intense cooling of at least one further area of the rolling stock, in particular the base of a rail, is disposed and that the final cooling area has a support for the rolling stock for its cooling to room temperature.

It was found that the straight or axially aligned positioning is important, particularly in connection with heat treatments to be performed partially in respect to the cross section or in partial areas of a profiled rolling stock. By preventing a curvature over the entire length or partial areas thereof it is possible to maintain the predetermined cooling conditions or the cooling intensities of the rolling stock even, viewed in the axial direction, so that differences in strength or hardness along a generatrix of the profile are eliminated. Research has shown that different distances from the wall of a coolant reservoir and/or from the spray cooling axis can cause overly proportional deviations of the hardness and strength values.

During positioning it is furthermore important that the rolling stock is subjected to plastic shaping by appropriate devices in order to prevent elastic returns to a possibly partially curved shape. In order to avoid the necessity of later straightening it is of great importance to bring the profiled rolling stock in an axially aligned manner into a cooling area by a straight-line transverse transport. In addition to this a manipulation device is provided in the cooling area, by which the transfer, holding, dipping into a cooling liquid tank or hardening of partial areas of the rolling stock as well as the transfer into a final cooling area are possible. In the process at least one additional cooling device can be provided for the intensified cooling of further cross-sectional areas.

In a further development of the invention it is of advantage that the additional cooling device can be placed against the rolling stock and its cooling intensity is controllable, so that a further local heat removal corresponding to the method can be set.

An embodiment is also advantageous, wherein the additional cooling device has parts for forming a local cooling unit flow which is essentially uninterrupted in the longitudinal or axial direction of the rolling stock and limited in the transverse direction and, if required, has a device for preventing an increased heat removal from the surface(s) adjoining the cooled surface. In this way, it is possible to form sharply limited cooling zones and to exclude adjacent areas from an intensified heat removal process or to create a lesser material hardness in them, wherein in accordance with a further embodiment the additional cooling device is designed as a moving pressure or spray cooling device.

The homogeneity of the hardness and strength values in the longitudinal direction of the profiled rolling stock can be further increased if the rolling stock can be moved in the cooling liquid in the longitudinal axial direction in respect to the dip tank and/or in respect to the additional cooling device, and/or if installations are disposed on the dip tank and/or in the cooling liquid itself by which the cooling liquid can be turbulently moved and/or set to oscillate. It was found that relative movements as well as oscillation movements or pressure waves between the cooling medium and the work piece even out the local cooling intensity and create advantageous heat treating conditions.

A rail in accordance with the invention, particularly one produced in accordance with one of the previously mentioned methods, possibly produced in an above described device is distinguished in that in its cross section the rail shows great material strength and hardness values in the upper area of the head, which values are reduced in the lower head area in the web and the peripheral parts of the base, and that in the center area in the bottom area of the base there are increased hardness values of the material compared with the peripheral parts and the web, wherein particularly even quality characteristics are achieved if essentially equal material hardness values have been set symmetrically with the main axis of the cross-sectional profile or symmetrically to the perpendicular axis of the cross-section of the rail. Such a rail displays improved use properties even under increased demands such as high axial loads and/or high frequency of use and/or small radii of curvature of the line.

The present invention is directed to a method for heat-treating profiled rolling stock, including track and railroad rails, having a profiled surface and increased heat removal from portions of the profiled surface during cooling in the gamma range of an iron based alloy material. A conversion into a fine pearlitic grain of increased strength, increased wear resistance, and increased hardness takes place in desired cross-sectional areas in a head area of the rails, and, if required, a deformation or bending, by a thermally caused warping of the profiled rolling stock, perpendicularly to the longitudinal axis thereof, is one of decreased and prevented, during cooling to room temperature. Following a structural conversion in more heavily cooled cross-sectional areas of the profiled rolling stock, an increased rigidity and fatigue strength, under reversed bending stresses, occurs. The method includes aligning the profiled rolling stock, at an average temperature of between 750° C. and 1100° C., straight in its longitudinal direction by plastic shaping, and moving the aligned profiled rolling stock, in its aligned state, in a transverse direction and holding same there. The method also includes evenly cooling of the aligned profiled rolling stock, in a first cooling, to a temperature below 860° C., with the same local cooling intensity, by radiation, in still air, removing heat from the first cooled profiled rolling stock, in a second cooling, in the longitudinal direction with an intensity which locally is essentially the same, but, when viewed in cross section, is circumferentially different, and increasing the cooling intensity in at least one zone at the circumference of the first cooled profiled rolling stock. Greater cooling intensities are assigned to areas with one of a large cross sectional ratio relative to the circumference and a large portion of volume with one of respect to the surface and a high mass concentration. The method further includes increasing a cooling speed of areas of the increased intensely cooled profiled rolling stock having locally high temperatures, and bringing these areas to a conversion temperature, under which cooling conditions, a fine pearlitic grain structure, free of martensite, is formed, and cooling the increased intensely cooled profiled rolling stock from the conversion temperature to room temperature, at the same local cooling intensity, in still air.

According to a feature of the instant invention, the average temperature of the profiled rolling stock is a maximum of 900° C.

In accordance with another feature of the present invention, the method may further include cooling a portion of the profiled rolling stock having the largest mass concentration in one of a dipping process and by dipping same into a cooling liquid, while, simultaneously removing heat via lesser cooling intensity, including one of compressed air and air-water spraying, from at least one rolling stock part having a lesser mass concentration, including the base of the rail, by providing increased cooling. The portion of the increased intensely cooled profiled rolling stock with respect to its cross section, which is dipped into a cooling liquid in a dip tank, can be moved in a longitudinal direction relative to one of the cooling liquid container and the dip tank, during cooling. Further, at least during the time in which the portion of the increased intensely cooled profiled rolling stock is dipped into the cooling liquid, the method can further include oscillating the cooling liquid. The largest mass concentration can include the head of the rail. The method can further include setting the degree of cooling intensity, including the composition of the cooling liquid for the dipping, in such a way that, in the temperature range between 800° C. to 450° C., cooling of the zone close to a surface, particularly of the dipped part, is achieved at a cooling rate of 1.6 to 2.4° C./s, and preferably about 2.0° C./s.

According to another feature of the invention, in the first cooling, the temperature can be about 820° C.

In accordance with still another feature of the invention, in the first cooling, the temperature can range from 5 to 120° above the $Ar_3$ temperature of the iron alloy material.

The aligning can further include hot forming the aligned profiled rolling stock, heat treating the aligned profiled rolling stock with hot forming heat at a degree of deformation ranging between about 1.8 to 8%, during a last tapping of the iron based alloy material, at a temperature in the range of 750° C. to 1050° C. The degree of deformation ranges from about 2 to 5%.

Further, in the second cooling, the cooling intensity can be increased in at least one of one and two zones at the circumference of the profiled rolling stock.

Moreover, the profiled rolling stock can have a T-shaped cross section, and the method can further include cooling, at the base of the rail, the zone or surface opposite the web of the T-shaped cross sectional rail, by one of compressed air and an air-water mixture. A surface zone, located opposite the web of increased cooling intensity can be essentially symmetrical with respect to the web axis and is limited in lateral extent.

According to a further feature of the present invention, the method can also include avoiding an increased cooling intensity in areas of the cross section of the first step cooled profiled rolling stock that are remote in distance from at least one of a mass concentration and a web juncture. Further, the method can include one of protecting the remote areas from increased heat removal and by at least briefly heating said areas.

In accordance with yet another feature of the instant invention, the method can include setting the cooling intensity, at the surface of the increased intensely cooled profiled rolling stock in such a way that the zones, in which the conversion of the gamma grain takes place during cooling, are essentially one of parallel symmetrical and parallel to a neutral plane thereof. The zones can be concentric with one of the line of the center of gravity and the center of gravity of the cross-sectional surface.

The present invention is directed to a method for heat-treating profiled rolling stock, adapted for track and railroad rails, having a profiled surface comprising an alloy. The method includes aligning the profiled rolling stock straight in its longitudinal direction by plastic shaping at an average temperature of between approximately 750° C. and 1100° C., and transversely moving the aligned profiled rolling stock to a holding area. The method also includes evenly cooling the profiled rolling stock to a temperature above that at which a conversion of the gamma grid into the alpha grid of the alloy begins at a cooling velocity of 3° C./min, whereby a partial conversion of the grain into a fine pearlitic structural shape occurs in portions of a cross-section of the profiled rolling stock, and unevenly removing heat from the profiled rolling stock, whereby a structural conversion occurs in more heavily cooled cross-sectional areas of the profiled rolling stock, whereby rigidity and fatigue strength, under reversed bending stresses, are increased. The method further includes cooling the increased intensely cooled profiled rolling stock from the conversion temperature to room temperature, at the same local cooling intensity, in still air.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
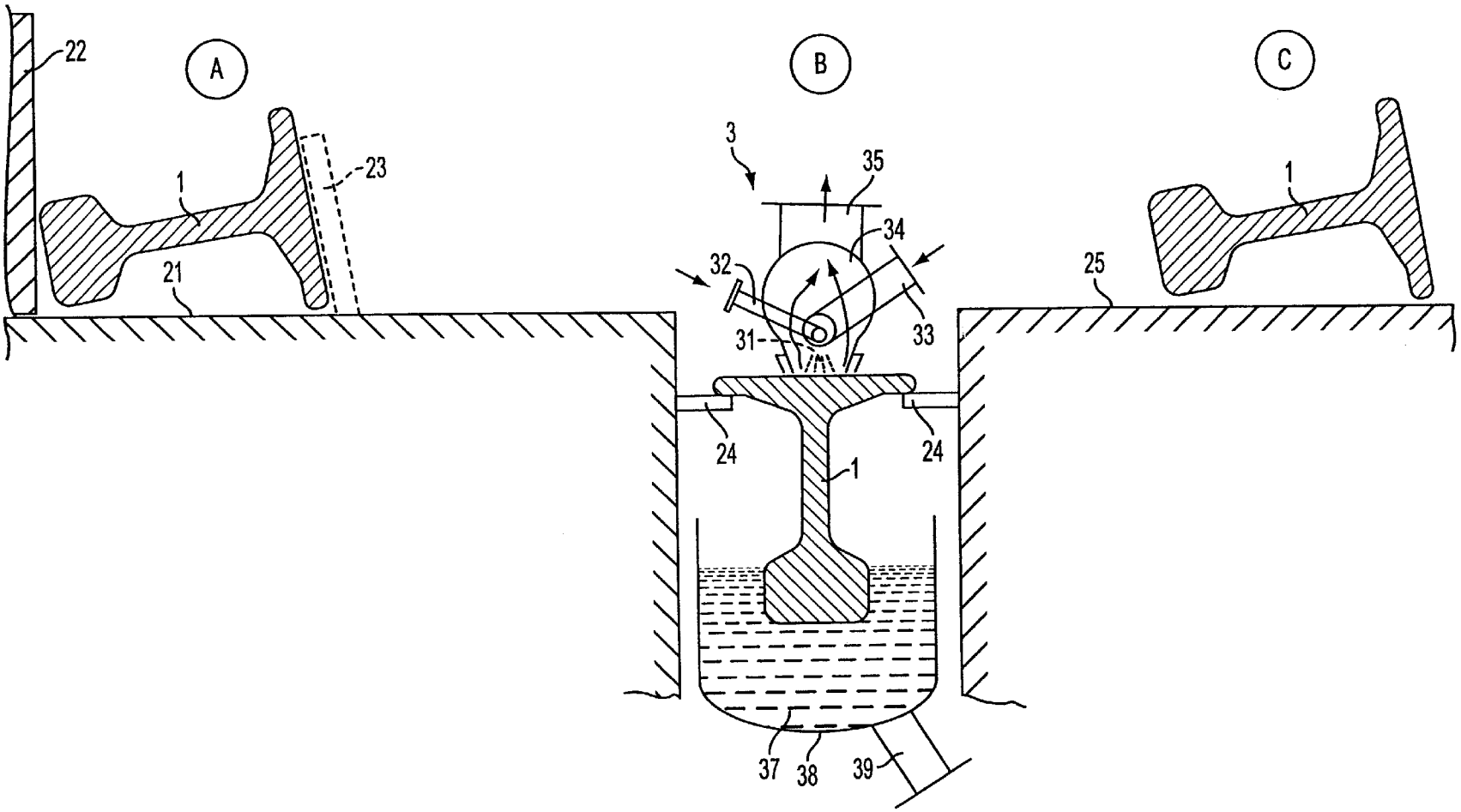
FIG. 1 illustrates a course for the heat treatment of rails in accordance with the features of the instant invention.

As schematically shown in FIG. 1, profiled rolling stock, such as a rail, is positioned in a stand-by area A at a roller table 21 by movable bumpers or the like, for example (not shown). The rail 1 is then aligned straight by alignment device 22 and 23, wherein a centering type of the alignment device 22 which also corrects a vertical curvature is advantageous. Following the alignment of the rolling stock 1, there is a transverse transport to a support 2 in a cooling area B and placement into a manipulation device with holding device 24, wherein holding during the movement must be performed in such a way that there is no bending transversely to the longitudinal axis. In a manner known per se, the rolling stock or the rail 1 is partially immersed by the holding device 24 into a cooling liquid 37 in a dip tank 38. Herein it is important that the distance of the surface of the rail 1 from the wall of the dip tank is equally great on both sides over its length. For intensifying and particularly for an equalization of the cooling intensity of a rolling stock surface, in an advantageous manner the rolling stock 1 can be movable in the dip tank 38 or the cooling medium 37 in a longitudinal direction in an amount of, for example 0.5 to 5 m. It is also possible to use oscillation generators (not shown) in the cooling medium 37 or on the dip tank, which cause the cooling medium to oscillate at a frequency of, for example, 100 to 800 oscillations/min, which advantageously affects the cooling intensity. A cooling medium inlet is identified by numeral 39.

An additional cooling device 3 can be placed on or attached to a flat part of the rolling stock, possibly on the base 13 of a rail 1. Such an additional cooling device can have a water supply 32 and an air supply 33 and form a spray 31 directed to a surface part of the rolling stock or the base of the rail. To provide a decreased cooling intensity to the peripheral parts 132 (FIG. 2) and to form a zone of increased material hardness only in a central area 131 (FIG. 2) of a rolling stock or rail base area, it can be advantageous to provide a cooling medium removal, for example, by an aspirating device 34, which is connected to a source of vacuum 35 or similar type device.

Figure 3:
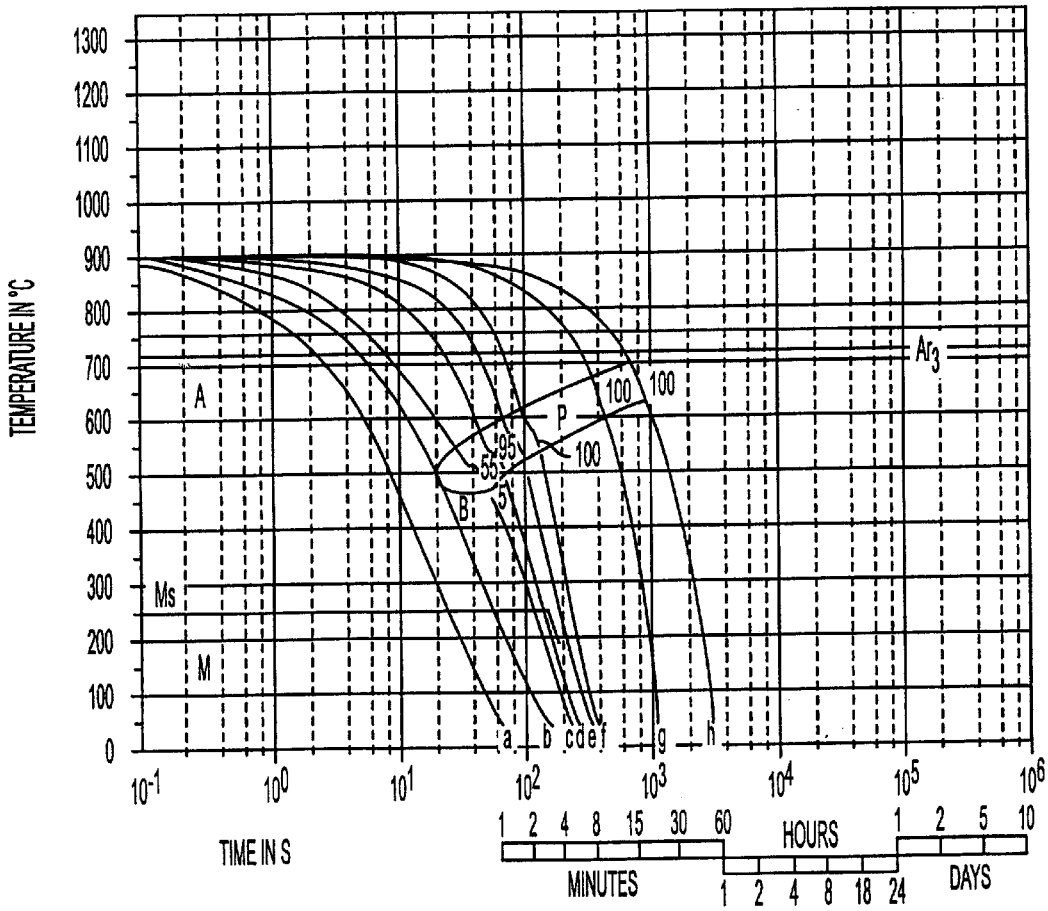
FIG. 3 (PRIOR ART)
FIG. 3 graphically illustrates a time-temperature conversion diagram of a rail material.

After cooling of the rolling stock, in particular a rail 1, immersed into a cooling medium 37 and in particular of a portion thereof located opposite it and subjected to a spray 31, below the conversion temperature of the material of an intensity causing a fine pearlific grain, for example in accordance with FIG. 3 to approximately 500° C. at a cooling rate in accordance with curve f, the rail can be placed on a support 25 in the final cooling area C for cooling to room temperature.

Figure 2:
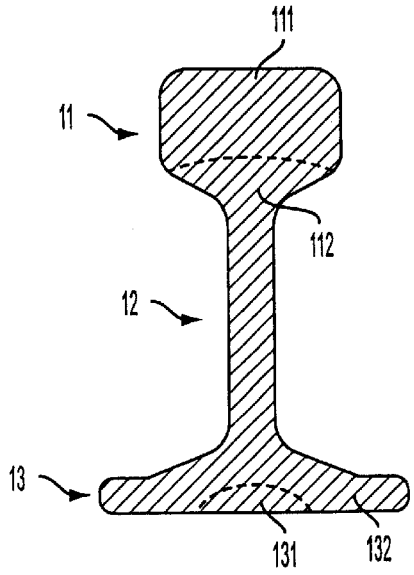
FIG. 2 illustrates a cross section of a rail.

As represented in FIG. 2, a rail 1, in accordance with the invention, has three areas of different grain structure or hardness, wherein the transition areas are embodied to be continuous. A fine pearlitic zone 111 of hardness values between 340 and 390 HB, possibly up to 425 HB, is provided in the rail head 11 and makes a downward transition into a zone 112 of reduced hardness, for example 300 to 340 HB. In the adjoining web 12, which in actual use must have a large degree of toughness, hardness values between 280 and 320 HB have accordingly been provided. A pearlitic grain of a rougher structure or lamella formation and a hardness between 280 to 320 HB, the same as in the web 12, is provided in the peripheral areas 132 of the rail base 13. Initiation of a rupture or break is prevented to a large extent by this grain embodiment and the material properties of reduced hardness values. However, an area 131 of increased material strength and hardness values of 300 to 350 HB and more is formed in the center of the bottom of the base 13. As has been determined, such a distribution in accordance with the invention of the mechanical properties of the material across the cross section of a rail cause high stability and advantageous long term behavior, particularly under difficult conditions.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A railroad rail of a steel alloy having a pearlitic microstructure, which rail comprises a rail head, a rail web and a rail base and has a weight of 30 to 100 kg/m, wherein the rail is formed of a steel alloy having a chemical composition in weight % of

| | |
|---|---|
| carbon (C) | 0.4 to 1.0 |
| silicon (Si) | 0.1 to 1.2 |
| manganese (Mn) | 0.5 to 3.5 |
| chromium (Cr) | up to 1.5, |

optionally other alloy elements below 1 weight %, the rest being iron (Fe) and impurities occurring in the manufacturing process, wherein at least the rail head has a portion of fine pearlitic grain microstructure and a hardness between 340 HB and 425 HB down to a sufficient depth from the top surface, the remaining rail portions have a hardness which is lower than said portion of fine pearlitic grain microstructure , wherein an arrangement and a size and extension, respectively, of the portion of fine pearlitic grain microstructure and increased hardness in the rail cross section is even along the entire length of the rail, and wherein the rail base has a hardness of 280 to 320 HB in peripheral areas thereof and an increased hardness of 300 to 350 HB in a central bottom portion, opposite the rail web.

2. The rail of claim 1, wherein the central bottom of the rail base has a higher hardness than the rail web.

3. The rail of claim 1, wherein the hardness decreases continuously from an upper rail head portion to a lower rail head portion and to the rail web.

* * * * *